United States Patent [19]

Welsh

[11] Patent Number: 4,841,693

[45] Date of Patent: Jun. 27, 1989

[54] PARTICULATE MATERIAL STORAGE STRUCTURE

[75] Inventor: Michael J. Welsh, Pekin, Ill.

[73] Assignee: UNR, Inc., Peoria, Ill.

[21] Appl. No.: 224,341

[22] Filed: Jul. 26, 1988

[51] Int. Cl.[4] ..... F04H 7/00; F26B 17/12

[52] U.S. Cl. ..... 52/197; 34/174

[58] Field of Search ..... 34/174, 172; 52/192, 52/194, 195, 197

[56] References Cited

U.S. PATENT DOCUMENTS

| | | | |
|---|---|---|---|
| 1,960,797 | 5/1934 | Sackett | 52/197 |
| 2,671,057 | 3/1954 | McClure | 34/174 |
| 3,006,377 | 10/1961 | Hamprecht | 52/197 |
| 3,342,352 | 9/1967 | Sackett, Sr. | 214/16 |
| 4,035,928 | 7/1977 | Sietmann | 52/192 |
| 4,201,695 | 5/1980 | Juntgen | 34/174 |
| 4,563,844 | 1/1986 | Driedger | 52/192 |

FOREIGN PATENT DOCUMENTS

| | | | |
|---|---|---|---|
| 1515164 | 3/1968 | France | 52/197 |
| 166818 | 3/1965 | U.S.S.R. | 52/197 |

*Primary Examiner*—John E. Murtagh

*Attorney, Agent, or Firm*—Dressler, Goldsmith, Shore, Sutker & Milnamow, Ltd.

[57] ABSTRACT

A building for storage grain or other particulate material. Two side walls spaced laterally from each other provide lateral support for the base of a pile of such particulate material and lower support for a roof. A roof spanning and supported fixedly on the side walls so as to cover the building has a ridge extending longitudinally, two arrays of structural trusses with one array extending between each of the side walls and the ridge and two canopies with one canopy covering the array on each side. Each canopy slopes upwardly from one of the side walls at an angle more than the angle of repose of such particulate material. A plurality of panels extend longitudinally, each depending from and supported fixedly by one of the arrays. The panels are arranged in several pairs facing each other on opposite sides of the ridge with each pair in a different tier. The panels of each tier are positioned vertically and horizontally to provide lateral support for a pile of such particulate material between the side walls and prevent the pile from bearing directly against the canopy on either side if and when the pile accumulates to heights where part of the pile comes between the panels of such tier. The panels transmit lateral and vertical forces, as imposed by the pile therebetween, to the arrays of structural trusses so that those forces are not borne directly by the canopy on either side.

8 Claims, 1 Drawing Sheet

PARTICULATE MATERIAL STORAGE STRUCTURE

BACKGROUND OF THE INVENTION

This invention pertains to a structure for storage of grain or other particulate material, such material possessing internal friction characteristics and having an angle of repose.

In the present context, the angle of repose is the maximum angle with the horizontal at which angle a particulate material will retain its position without starting to slide. Although the angle of repose varies with such factors as the distribution of fine and coarse particles of the particulate material and its moisture content, it is useful to refer to nominal or typical values for the angles of repose of different materials. As an example, the angle of repose of corn has a nominal or typical value of about 22°. The angles of repose of most types of grain have nominal or typical values of less than about 30°. Each reference to an angle of repose of any particulate material, hereinafter, is intended to refer to the nominal or typical value of the angle of repose of the particulate material.

It is known to store grain or other particulate material within a variety of storage structures including silos with cylindrical walls of circular cross-sections and rectangular buildings. Typically, when grain or other particulate material is stored within a rectangular building having a flat roof or a roof with a canopy sloping at an angle less than the angle of repose of such particulate material, horizontal forces imposed by a pile of such particulate material reaching outer walls of the building are borne by those walls, not by the structural system which supports the canopy of the roof or by the canopy itself.

As increased capacity to store grain or other particulate material has been sought, heretofore, it has been conventional to provide a longer or wider building or a building with higher walls capable of bearing horizontal forces imposed by a pile of such particulate material reaching those walls. If a building of a type used conventionally to store grain or other particulate material had a roof with a canopy sloping at an angle more than the angle of repose of grain or other particulate material stored in a pile within the building, and if the pile were to accumulate to heights reaching the canopy, the pile would impose horizontal forces on the canopy, which would be most likely unable to bear such forces without distortion or rupture.

This invention fills a need, therefore, for an improved structure for storage of grain or other particulate material.

SUMMARY OF THE INVENTION

This invention provides an improved structure, such as a building, for storage of grain or other particulate material. This invention provides the ability to physically retain a particulate material through the use of panels spaced vertically and horizontally to achieve stability of the particulate material and take full advantage of its internal frictional characteristics. This ability allows the structure to have increased capacity without increased area of ground coverage and without higher walls capable of bearing horizontal forces imposed by a pile of such particulate material reaching those walls. This invention allows an increased percentage of storage particulate material to be automatically reclaimed with conventional reclaim equipment. Substantial cost savings may be thus realized.

According to a preferred embodiment of this invention, the structure comprises walls enclosing the building at least partially and including two side walls spaced laterally from each other. The side walls are adapted to provide lateral support for the base of a pile of such particulate material between the side walls and to provide lower support for a roof.

Moreover, the structure comprises a roof spanning and supported fixedly on the side walls so as to cover the building, preferably a saddle roof but possibly a hip, gambrel, mansard, or ogee roof, so long as the roof has an actual or theoretical ridge extending longitudinally. Herein, a roof having a flat top between two canopies sloping so as to converge upwardly, such as a mansard roof, is regarded as having one theoretical ridge where the canopies would intersect if extended upwardly. The roof has two arrays of structural trusses with one array of structural trusses extending between each of the side walls and the ridge. The roof has two canopies with one canopy covering the array of structural trusses with one canopy on each side of the ridge. Each canopy slopes upwardly from one of the side walls at an angle more than the angle of repose of such particulate material.

Furthermore, the structure comprises a plurality of panels extending longitudinally, each depending from and supported fixedly by one of the arrays of structural trusses. The panels are arranged in at least one pair facing each other on opposite sides of the ridge, preferably three pairs facing each other on opposite sides of the ridge with each pair of a different tier, the panels of each pair being spaced horizontally from each other and positioned vertically so as to provide lateral support for a pile of such particulate material accumulated initially between the side walls and prevent the pile from bearing directly against the canopy on either side if and when the pile accumulates subsequently to heights where part of the pile comes between the panels of such pair.

The panels of each pair transmit horizontal forces and vertical friction forces, as imposed by a pile of such particulate material, to the arrays of structural trusses so that those forces are not borne directly by the canopy on either side of the ridge.

If the panels are arranged in a plurality of pairs facing each other with the panels of each pair in a different tier, the panels are to be then closer to each other in a higher tier and farther from each other in a lower tier, the panels of each tier being spaced horizontally from each other and positioned vertically so as to provide lateral support for a pile of such particulate material accumulated initially between the side walls and prevent the pile from bearing directly against the canopy on either side of the ridge if and when the pile accumulates subsequently to heights where part of the pile comes between the panels of such tier.

The panels must be geometrically positioned at proper heights and horizontal locations such that the particulate material reposes in static equilibrium. The proper geometric positioning for the panels depends on the amount of internal friction of the material and on the surcharge pressures exerted by the material at higher levels on the material at lower levels. Known analytical methods may be advantageously employed to determine the amount of internal friction and the surcharge pressures, e.g., analytical methods used commonly by geotechnical engineers working with soil mechanics.

The structure may be advantageously ventilated between the canopy on each side of the ridge and regions where a pile of such particulate material can accumulate between the panels of each tier.

The structure may be also provided with means for conveying such particulate material into the building and discharging such particulate material in a pile that can accumulate initially between the side walls and subsequently between the panels of each tier.

The structure may be also provided with a floor spanning the side walls, either level or sloping downwardly from each of the side walls toward a trough extending longitudinally. If provided with such a level or sloping floor and with such a trough, the building may be also provided with means for conveying such particulate material from the building via the trough.

It is envisioned that this invention may be also embodied in a structure resembling what has been described above but comprising a lean-to roof supported fixedly on one side wall, wherein the roof has one array of structural trusses and a canopy covering the array and sloping upwardly at an angle more than the angle of repose of the particulate material to be stored within the structure, and wherein the structure comprises one such panel, preferably a plurality of such panels at different heights, the panel or panels extending longitudinally and depending from and supported fixedly by the array of structural trusses. A pile of grain or other particulate material may be then supported on its opposite side by a higher wall, e.g., a masonry wall of another structure.

It is envisioned that this invention may be also embodied in a structure resembling what has been described above but comprising a side wall that is cylindrical or conical and a conical roof supported fixedly by the side wall, the roof having an array of structural trusses conforming to the conical roof and a conical canopy sloping upwardly at each point where the roof meets the side wall at an angle more than the angle of repose of grain or other particulate material to be stored within the structure, and comprising at least one panel depending from and supported fixedly by the array of structural trusses, preferably a plurality of such panels at different heights, the panel or each of the panels extending cylindrically.

These and other objects, features, and advantages of this invention are evident from the following description of a preferred embodiment of this invention with reference to the accompanying drawing.

BRIEF DESCRIPTION OF THE DRAWING

In FIG. 2, certain features shown in FIG. 1 have been omitted, so as to reveal other features.

DETAILED DESCRIPTION OF PREFERRED EMBODIMENT

Figure 1:
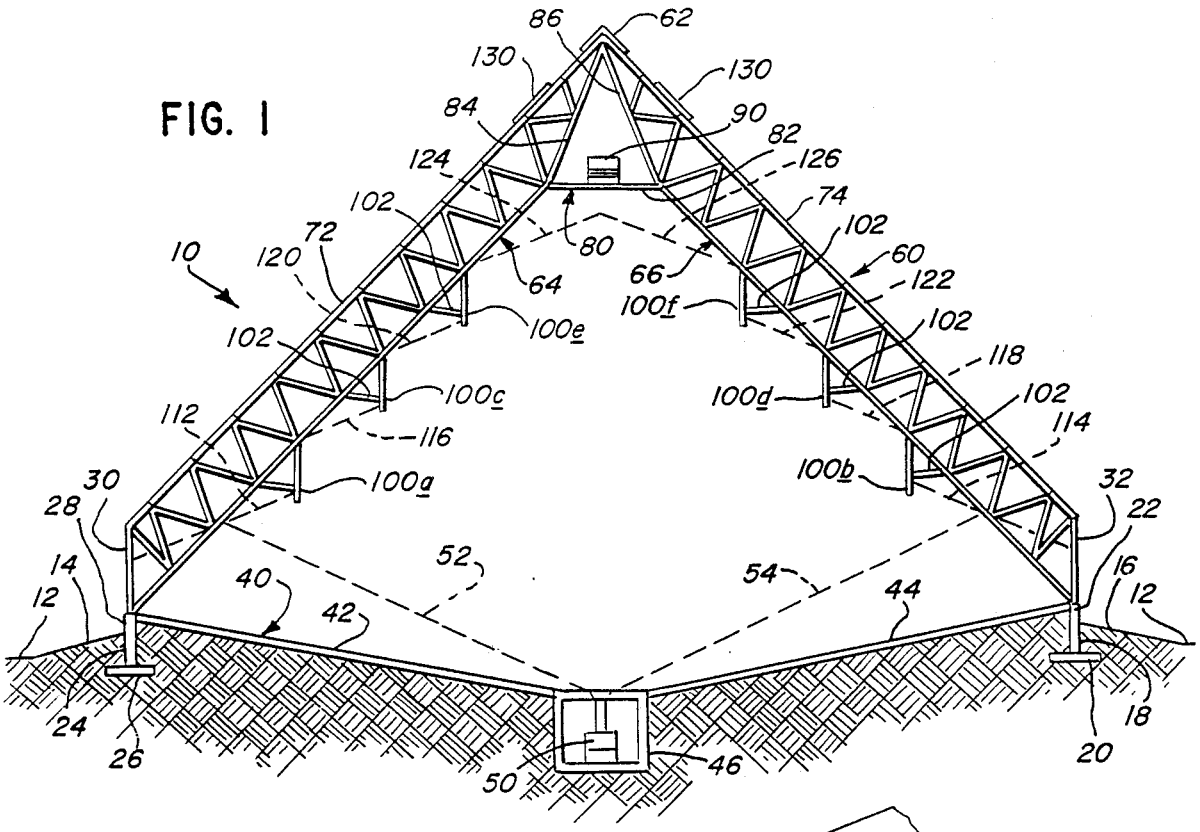
FIG. 1 is a diagrammatic view of one end of a building for storage of grain, the building constituting a preferred embodiment of this invention.

As shown diagrammatically in the drawing, a building 10 for storage of grain, such as corn having an angle of repose of about 22°, constitutes a preferred embodiment of this invention.

The building 10 is shown as erected on an existing grade 12 with a drainage berm on each side of the building 10, i.e., a drainage berm 14 on its left side and a drainage berm 16 on its right side. On the right side of the building 10, a lower wall 18 of continuous concrete is supported immobily on a continuous concrete footing 20, below the existing grade 12 and the drainage berm 16 except for an upper portion 22 of the concrete wall 18. On the left side of the building 10, a lower wall 24 of continuous concrete is supported immobily on a continuous concrete footing 26, below the existing grade 12 and the drainage berm 16, except for an upper portion 28 of the concrete wall 24.

The building 10 has an upper wall 30, which is supported fixedly on the lower wall 24 of continuous concrete, and an upper wall 32, which is supported fixedly on the lower wall 22 of continuous concrete. The walls 30, 32, which may be collectively called the side walls of the building 10, may be advantageously assembled from linear panels of a conventional type, of galvanized, enameled steel or other suitable material. An upper portion of each of the side walls 30, 32, may be similarly provided with louvers 34.

The building 10 has a floor 40 spanning the side walls 30, 32, and including a left portion 42, a right portion 44, and a trough 46 extending longitudinally along and substantially through the building 10 between the respective portions 42, 44, of the floor 40. The left portion 42 slopes downwardly from the juncture of the left walls 24, 30, toward the trough 46, and the right portion 44 slopes downwardly from the juncture of the right walls 18, 32, toward the trough 46, each sloping downwardly toward the trough 46, at an angle of about 11°, as shown. The angle is not critical.

Figure 2:
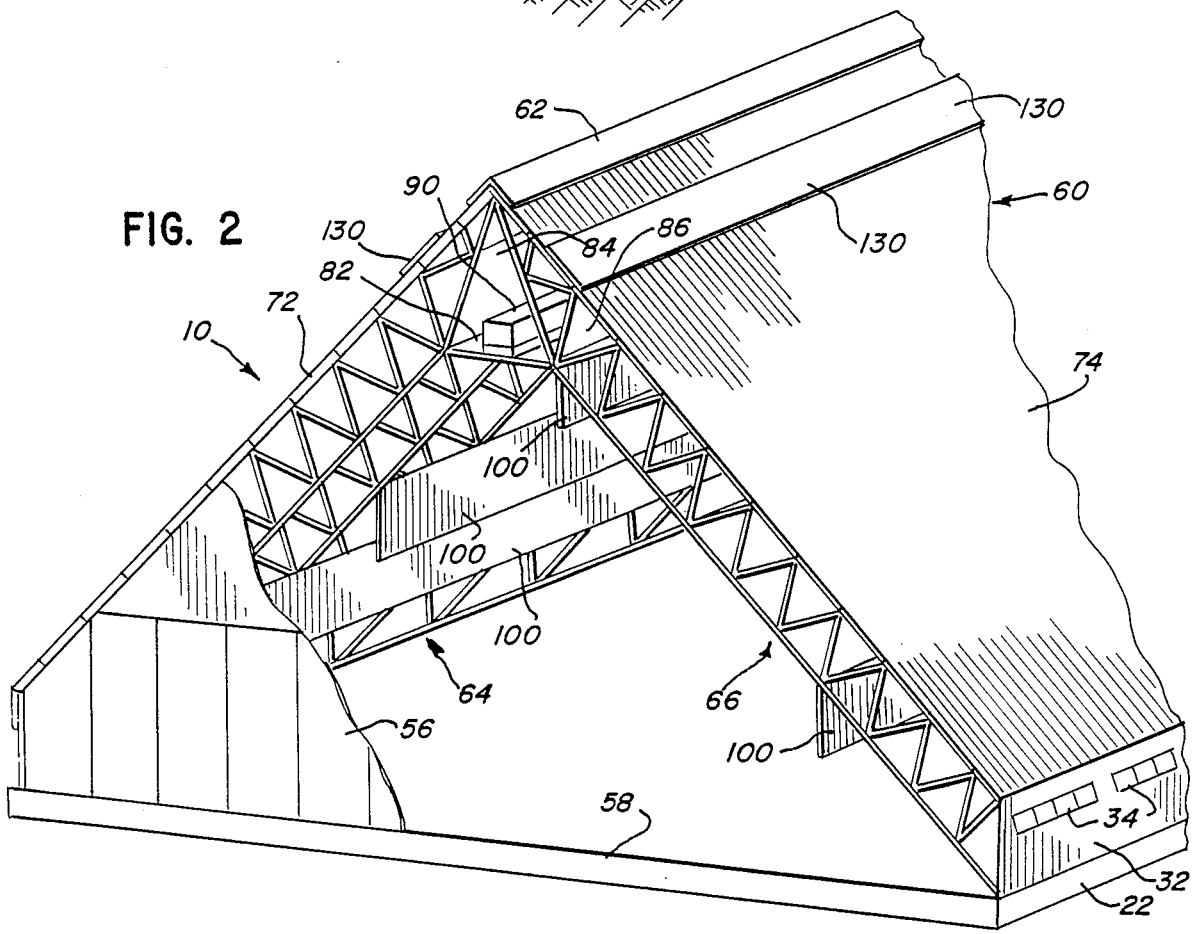
FIG. 2 is a diagrammatic, fragmentary, perspective view of the building of FIG. 1.

A reclaim conveyor 50 of a conventional type is mounted in the trough 46 so as to extend longitudinally along and substantially through the building 10, and is operable to convey grain from the building 10 via the trough 46 so as to reclaim grain stored in the building. In FIG. 2, hatched lines 52, 54, indicate upper surfaces of two residual masses of grain, such masses remaining after as much as can be automatically reclaimed by means of the reclaim conveyor 50 has been reclaimed from a pile of grain within the building 10. Hereinafter, reclaim percentage refers to as much as can be automatically reclaimed by means of conventional reclaim equipment, such as the reclaim conveyor 50, as expressed as a percentage of maximum storage capacity. Such residual masses must be otherwise reclaimed. These surfaces 52, 54, conform to the angle of repose of grain constituting such masses.

The building 10 may be partially or completely enclosed by the side walls 30, 32, and by a back wall (not shown) and a front wall 56, which may include a door or doors (not shown) for personnel, equipment, or both, and which may be advantageously assembled from lower panels of a conventional type, of precast concrete or other suitable material, and upper panels of a conventional type, of galvanized, enameled steel or other suitable material. As shown, the front wall 56 is supported fixedly on a continuous concrete wall 58 like the concrete walls 18, 24, which are connected by the concrete wall 58. The back wall may be similarly assembled and similarly supported.

The building 10 comprises a roof 60 spanning and supported fixedly on the side walls 30, 32, preferably a saddle roof, as shown, although a hip, gambrel, mansard, or ogee roof may be alternatively used. The roof 60 has a ridge defined by a ridge cap 62 extending longitudinally along the building 10. The roof 60 has two arrays of structural trusses, preferably all-steel trusses although trusses with wooden chords and steel webs, trusses with wooden chords and wooden webs, or trusses of structural plastics may be alternatively used. Thus, the roof 60 has a left array 64 of structural trusses extending between the wall 30 on the left side and the ridge 62. Also, the roof 60 has a right array 66 of structural trusses extending between the wall 32 on the right side and the ridge 62. The arrays 64, 66, of structural trusses are supported on the side walls 30, 32, which support the roof 60.

Moreover, the roof 60 has two canopies, each of which may be advantageously assembled of linear panels of a conventional type, of galvanized, enameled steel, or other suitable material. Thus, the roof 60 has a left canopy 72 covering the left array 64 of structural trusses. Also, the roof 60 has a right canopy 74 covering the right array 66 of structural trusses. The left canopy 72 slopes upwardly from the upper edge of the wall 30 on the left side toward the ridge defined by the ridge cap 62 and the right canopy 72 slopes upwardly from the upper edge of the right wall 32 toward the ridge defined by the ridge cap 62, each sloping upwardly at an angle more than the angle of repose of grain of a particular type to be usually stored in the building 10, e.g., at an angle of about 45°, as shown.

The building 10 comprises a gallery 80, which is defined by a platform 82 suspended beneath the ridge 62, a left panel 84 mounted between the left canopy 72 and the left edge of the platform 82, and a right panel 86 mounted between the right canopy 74 and the right edge of the platform 82. The platform 82, the left panel 84, and the right panel 86 extend longitudinally along the building 10.

A fill conveyor 90 of a conventional type is mounted on the platform 82 and is operable to convey grain into the building 10 via apertures (not shown) in the platform 82 and discharging grain along the fill conveyor 90 in a pile that can accumulate initially between the side walls 30, 32, and subsequently between panels to be next described. The fill conveyor 90 extends substantially but not completely through the building 10 so that such a pile can accumulate where the pile will not impose horizontal forces on the upper panels of the front wall or on any similar panels of the back wall.

According to an important aspect of this invention, the building 10 comprises a plurality of panels 100 positioned at specific heights and horizontal locations and extending longitudinally along the building. Thus, six panels 100 are shown in FIG. 2, not all of the panels 100 being shown in FIG. 1. Each of the panels 100 depends from and is supported fixedly by one of the arrays 64, 66, of structural trusses, three depending from and being supported by the array 64 and three depending from and being supported by the array 66. A series of braces 102 spaced longitudinally from one another brace each of the panels 100 along its lower edge to whichever of the arrays 64, 66, supports it. Each of the panels 100 may be advantageously made in multiple pieces abutted or connected longitudinally to one another, each of galvanized, enameled steel or other suitable material. Each of the panels 100 has vertical corrugations for enhanced stiffness.

The panels 100 are arranged in three pairs facing each other with each pair in a different tier, i.e., a pair constituted by one panel **100*a* on the left side and one panel 100*b* on the right side in a lowest tier, a pair constituted by one panel 100*c* on the left side and one panel 100*d* on the right side in a middle tier, and a pair constituted by one panel 100*e* on the left side and one panel 100*f* on the right side in a highest tier. The panels 100*a*, 100*b*, of the pair in the lowest tier are lower and farther from each other than the panels 100*c*, 100*d*, of the pair in the middle tier, and vice-versa. The panels 100*c*, 100*d*, of the pair in the middle tier are lower and farther from each other than the panels 100*e*, 100*f***, of the pair in the highest tier, and vice-versa. Although three tiers, as shown, are preferred for storage of corn, a greater or lesser number of such tiers may be alternatively used and may be actually required for static equilibrium of a particulate material of a particular type.

The panels 100 are positioned to provide lateral support for a pile of grain accumulated initially between the side walls 30, 32, and prevent the pile from bearing against either of the canopies 72, 74, if and when the pile accumulates subsequently to heights where part of the pile comes between the panels **100*a*, 100*b*, of the pair in the lowest tier, if and when the pile accumulates subsequently to heights where part of the pile comes between the panels 100*c*, 100*d*, of the pair of the middle tier, and if and when the pile accumulates ultimately to heights where part of the pile comes between the panels 100*e*, 100*f*, of the pair in the highest tier, so as to approach maximum storage capacity of the building 10. In FIG. 2, hatched lines indicate upper surfaces of the pile at each stage, i.e., hatched lines 112, 114, indicating upper surfaces of the pile where accumulated between the side walls 30, 32, hatched lines 116, 118, indicating upper surfaces of the pile where accumulated between the panels 100*a*, 100*b*, of the pair in the lowest tier, hatched lines 120, 122, indicating upper surfaces of the pile where accumulated between the panels 100*c*, 100*d*, of the pair in the middle tier, and hatched lines 124, 126, indicating upper surfaces of the pile where accumulated between the panels 100*e*, 100*f*, of the pair in the highest tier, essentially at maximum storage capacity for a unit length of the building 10. These surfaces 112, 114, 116, 118, 120, 122, 124, 126**, conform to the angle of repose of grain constituting the pile.

The panels 100 of each pair transmit lateral forces and vertical friction forces, as imposed by a pile of grain between the panels 100 of such pair, to the arrays 64, 66, of structural trusses so that those forces are not borne directly by either of the canopies 72, 74. The canopies 72, 74 can be thus designed merely for external wind, rain, and snow loads, which may be much smaller than those forces.

The arrays 64, 66, of structural trusses can be thus designed not only for external wind, rain, and snow loads but also for internal loads imposed by the pile. Except for vertical friction forces, the internal loads oppose the external loads and oppose the self-weight of the structural trusses, canopies, and panels. The opposition of the external and internal loads allows for structural economy in the design of the structural trusses.

Besides being ventilated via the louvers 34, the building may be advantageously ventilated via elongated vents 130 installed in the canopies 72, 74, and adapted to be selectively opened and closed along elongated hinges (not shown) by conventional means (not shown) so that warm air and evolved gases can be safely vented. Ventilation can be enhanced by the use of forced-air ventilation through perforated metal covers (not shown) over the trough 46 or through aeration ducts (not shown) provided in the floor 40, or laid upon the floor 40, in a conventional manner.

The arrays 64, 66, of structural trusses provide wide regions where air can circulate between the canopies 72, 74, and regions where a pile of grain can accumulate.

The building may be also provided with other features (not shown) known in storage buildings for similar purposes, e.g., an aspirating system to remove explosive dust or a temperature-monitoring system to detect spoilage and determine aeration requirements.

Although the building 10 can be custom-designed for a particular type of grain or other particulate material, the building 10 can conform to a standard design, as shown and described, which is suitable for corn and other types of grain. As mentioned above, the angles of repose of most types of grain have nominal or typical values of less than about 30°.

Furthermore, most types of grain possess sufficient internal friction to achieve a stable pile in a structure embodying this invention, as exemplified by the building 10.

Nominal dimensions for such buildings include building widths ranging from more than 100 feet to about 200 feet, building lengths ranging from more than 100 feet to more than 700 feet, and heights ranging from about 40 feet to about 100 feet from gallery to floor, so as to achieve storage capacities ranging from more than 300,000 bushels of grain to more than 4,000,000 bushels of grain. Other dimensions and storage capacities are possible. Whereas reclaim percentages for conventional storage buildings usually are less than 40%, reclaim percentages approaching or exceeding 70% may be thus achieved with a structure embodying this invention.

Other modifications may be also made without departing from the scope and spirit of the invention.

I claim:

1. A structure for storage of grain or other particulate material, such particulate material having an angle of repose and possessing internal friction characteristics, the structure comprising:

(a) walls enclosing the structure at least partially and including two side walls spaced laterally from each other, positioned to provide lateral support for the base of a pile of such particulate material between the side walls, and adapted to provide lower support for a roof;

(b) a roof spanning and supported fixedly on the side walls so as to cover the structure, the roof having a ridge extending longitudinally along the building, the roof having two arrays of structural trusses with one array of structural trusses extending between each of the side walls and the ridge, the roof having two canopies with one canopy covering the array of structural trusses on each side of the ridge, each canopy sloping upwardly from one of the side walls at an angle more than the angle of repose of such particulate material;

(c) a plurality of panels mounted within and extending longitudinally along the structure, the panels being arranged in at least one pair facing each other on opposite sides of the ridge, the panels of each pair being positioned vertically and horizontally to provide lateral support for a pile of such particulate material accumulated initially between the side walls and prevent the pile from bearing directly against the canopy on either side of the ridge if and when the pile accumulates subsequently to heights where part of the pile comes between the panels of such pair, each panel depending from and supported fixedly by one of the arrays of structural trusses so that the panels of each pair transmit lateral forces and vertical friction forces, as imposed by a pile of such particulate material between the panels of such pair, to the arrays of structural trusses and so that those forces are not borne directly by the canopy on either side of the ridge.

2. The structure of claim 1 wherein the panels are arranged in a plurality of pairs facing each other with the panels of each pair in a different tier, in which the panels are closer to each other in a higher tier and farther from each other in a lower tier, the panels of each tier being positioned vertically and horizontally to provide lateral support for a pile of such particulate material accumulated initially between the side walls and prevent the pile from bearing directly against the canopy on either side of the ridge if and when the pile accumulates subsequently to heights where part of the pile comes between the panels of such tier.

3. The structure of claim 1 or claim 2 being ventilated between the canopy on each side of the ridge and regions where a pile of such particulate material can accumulate between the side walls and between the panels of each pair.

4. The structure of claim 3 further comprising:

(d) means for conveying such particulate material into the building and discharging such particulate material in a pile that can accumulate initially between the side walls and subsequently between the panels of each pair.

5. The structure of claim 4 further comprising:

(e) a floor extending spanning the side walls and sloping downwardly from each of the side walls toward a trough extending longitudinally along the structure.

6. The structure of claim 5 further comprising:

(f) means for conveying such particulate material from the structure via the trough.

7. A structure for storage of grain or other particulate material, such particulate material having an angle of repose and possessing internal friction characteristics, the structure comprising:

(a) a side wall positioned to provide lateral support for the base of a pile of such particulate material against the side wall and adapted to provide lower support for a roof;

(b) a roof supported fixedly on the side wall so as to cover the structure, the roof having an array of structural trusses and a canopy covering the array of structural trusses, the canopy sloping upwardly from each point where the roof meets the side wall at an angle more than the angle of respose of such particulate material;

(c) a panel mounted within the structure and positioned vertically and horizontally to provide lateral support for a pile of such particulate material accumulated initially against the side wall and prevent the pile from bearing directly against the canopy if and when the pile accumulates subsequently to heights where part of the pile comes against the panel, the panel depending from and supported fixedly by the array of structural trusses so that the panel transmits lateral forces and vertical friction forces, as imposed by a pile of such particulate material against panel, to the array of structural trusses and so that those forces are not borne directly by the canopy.

8. The structure of claim 7 wherein the panel is one of a plurality of panels extending longitudinally along the structure with each panel at a different height, each panel depending from and supported fixedly by the array of structural trusses, the panels being positioned vertically and horizontally to provide lateral support for a pile of such particulate material accumulated initially against the side wall and prevent the pile from bearing directly against the canopy if and when the pile accumulates subsequently to heights where part of the pile comes against at least one of the panels.

* * * * *